US007802710B1

(12) United States Patent
Hung

(10) Patent No.: US 7,802,710 B1
(45) Date of Patent: Sep. 28, 2010

(54) NAIL PUSHER THAT CAN PUSH NAILS SUCCESSIVELY

(75) Inventor: Ying-Feng Hung, Lugang Township, Changhua County (TW)

(73) Assignee: Yeun Chang Hardware Tool Co., Ltd., Changhua County (TW)

( * ) Notice: Subject to any disclaimer, the term of this patent is extended or adjusted under 35 U.S.C. 154(b) by 114 days.

(21) Appl. No.: 12/240,051

(22) Filed: Sep. 29, 2008

(51) Int. Cl.
*B27F 7/00* (2006.01)

(52) U.S. Cl. ..... 227/120; 227/147; 227/148; 173/90

(58) Field of Classification Search ..... 227/120, 227/147, 148; 173/90
See application file for complete search history.

(56) References Cited

U.S. PATENT DOCUMENTS 3,601,168 A * 8/1971 Fernstrom ..... 81/435
3,633,811 A * 1/1972 Ploen ..... 227/109
3,659,768 A * 5/1972 Brunelle ..... 227/10
3,741,455 A * 6/1973 Wendel et al. ..... 227/8
3,891,014 A * 6/1975 Gunn ..... 81/57.37
4,302,991 A * 12/1981 Brouse et al. ..... 81/429
4,621,758 A * 11/1986 Anstett ..... 227/147
4,627,563 A * 12/1986 Meyer ..... 227/130
4,860,937 A * 8/1989 Arnold ..... 227/147
4,998,452 A * 3/1991 Blum ..... 81/57.37
5,579,975 A * 12/1996 Moorman ..... 227/8
5,584,221 A * 12/1996 Petrantoni ..... 81/434
6,267,284 B1 * 7/2001 Clark ..... 227/8
6,450,388 B1 * 9/2002 Denton ..... 227/120
6,910,539 B2 * 6/2005 Carter ..... 173/1
6,926,186 B2 * 8/2005 Wells ..... 227/129
2004/0011847 A1 * 1/2004 Wells ..... 227/130
2005/0039933 A1 * 2/2005 Carter ..... 173/1
2005/0235779 A1 * 10/2005 Haytayan ..... 81/52

* cited by examiner

*Primary Examiner*—Brian D Nash
(74) *Attorney, Agent, or Firm*—Alan Kamrath; Kamrath & Associates PA

(57) ABSTRACT

A nail pusher includes a handle, a guide tube mounted in the handle and having a nail guide slot, a nail magazine mounted on the handle, a plurality of nails mounted in the nail magazine, a push member movably mounted in the nail magazine to push each of the nails through the nail guide slot into the guide tube, and a thrusting rod mounted on the handle and movable in the guide tube to thrust one of the nails outwardly from the guide tube. Thus, the push member is pushed to introduce each of the nails into the guide tube successively, and the nails are ejected outwardly from the guide tube successively, so that the nail pusher can push and eject the nails successively.

16 Claims, 9 Drawing Sheets

NAIL PUSHER THAT CAN PUSH NAILS SUCCESSIVELY

BACKGROUND OF THE INVENTION

1. Field of the Invention

The present invention relates to a nail pusher and, more particularly, to a nail pusher that helps a user pushing or striking nails onto an object, such as a wood board, and the like.

2. Description of the Related Art

A conventional nail pusher in accordance with the prior art shown in FIGS. 8 and 9 comprises a handle "b" having an inner wall provided with a shaft hole "b2" and an outer wall provided with multiple protruding ribs "b1", a guide tube "c" mounted in the shaft hole "b2" of the handle "b" and having an inner wall provided with a through hole "c1" and a periphery provided with two receiving holes "c2" to receive two balls "c3", a mounting seat "d" having an upper end provided with an insert "d1" inserted between the lower end of the guide tube "c" and the lower end of the handle "b" and a lower end provided with a receiving space "d2" and having a periphery provided with two pivot slots "d3", two clamping jaws "e" pivotally mounted in the pivot slots "d3" of the mounting seat "d" by two pivot pins "g" and each having a first end provided with a press portion "e1" and a second end provided with a clamping portion "e3", two torsion springs "f" mounted on the two pivot pins "g" and biased between the two clamping jaws "e" and the mounting seat "d", and a thrusting rod "a" movably mounted in the through hole "c1" of the guide tube "c" and having an upper end provided with a striking head "a1" that is movable to abut an enlarged top portion "b3" of the handle "b" and a lower end that is movable into the receiving space "d2" of the mounting seat "d" between the two clamping jaws "e". In operation, a nail (not shown) is mounted in the receiving space "d2" of the mounting seat "d" and clamped by the clamping portions "e3" of the two clamping jaws "e". Thus, when the striking head "a1" of the thrusting rod "a" is hit by a hammer (not shown), the thrusting rod "a" is pushed downward to force the nail into an object (not shown), such as a wood board, and the like. However, only a single nail is allowed to enter the receiving space "d2" of the mounting seat "d", so that the conventional nail pusher cannot push nails successively, and a user has to feed nails into the receiving space "d2" of the mounting seat "d" step by step, thereby causing inconvenience to the user when feeding the nails.

BRIEF SUMMARY OF THE INVENTION

In accordance with the present invention, there is provided a nail pusher, comprising a handle, a guide tube mounted in the handle and having a peripheral wall provided with a nail guide slot, a nail magazine mounted on the handle and connected to the nail guide slot of the guide tube, a plurality of nails mounted in the nail magazine, a push member movably mounted in the nail magazine and abutting the nails to push each of the nails through the nail guide slot of the guide tube into the guide tube, and a thrusting rod movably mounted on the handle and movable in the guide tube to thrust one of the nails in the guide tube and to eject one of the nails outwardly from the guide tube.

The primary objective of the present invention is to provide a nail pusher that can push nails successively.

Another objective of the present invention is to provide a nail pusher, wherein the push member is pushed by the elastic member to introduce each of the nails into the bore of the guide tube successively, and the nails are ejected outwardly from the bore of the guide tube successively, so that the nail pusher can push and eject the nails successively.

A further objective of the present invention is to provide a nail pusher, wherein the push member is pushed by the elastic member to introduce each of the nails into the bore of the guide tube successively, so that the nails are fed into the bore of the guide tube automatically, thereby facilitating the user feeding the nails.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
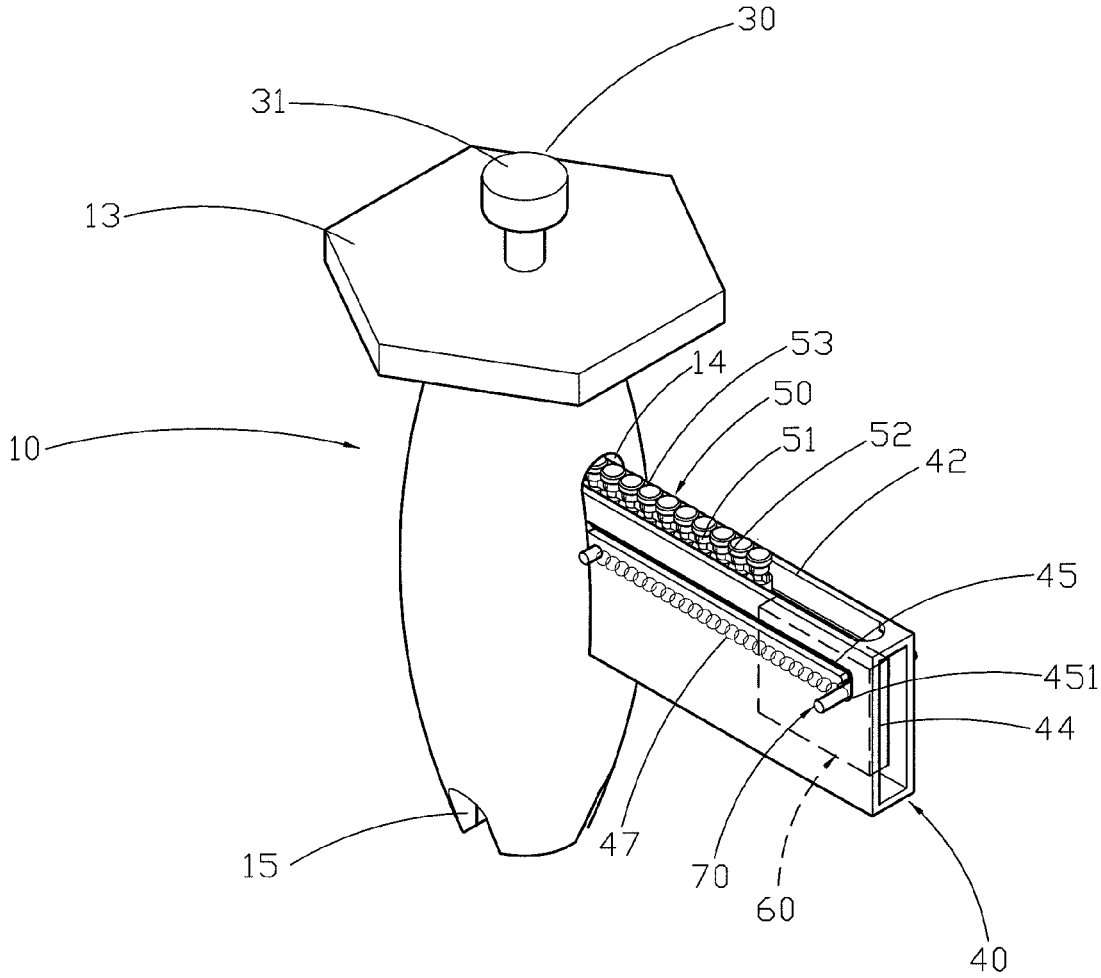
FIG. 1 is a perspective view of a nail pusher in accordance with the preferred embodiment of the present invention.
Figure 2:
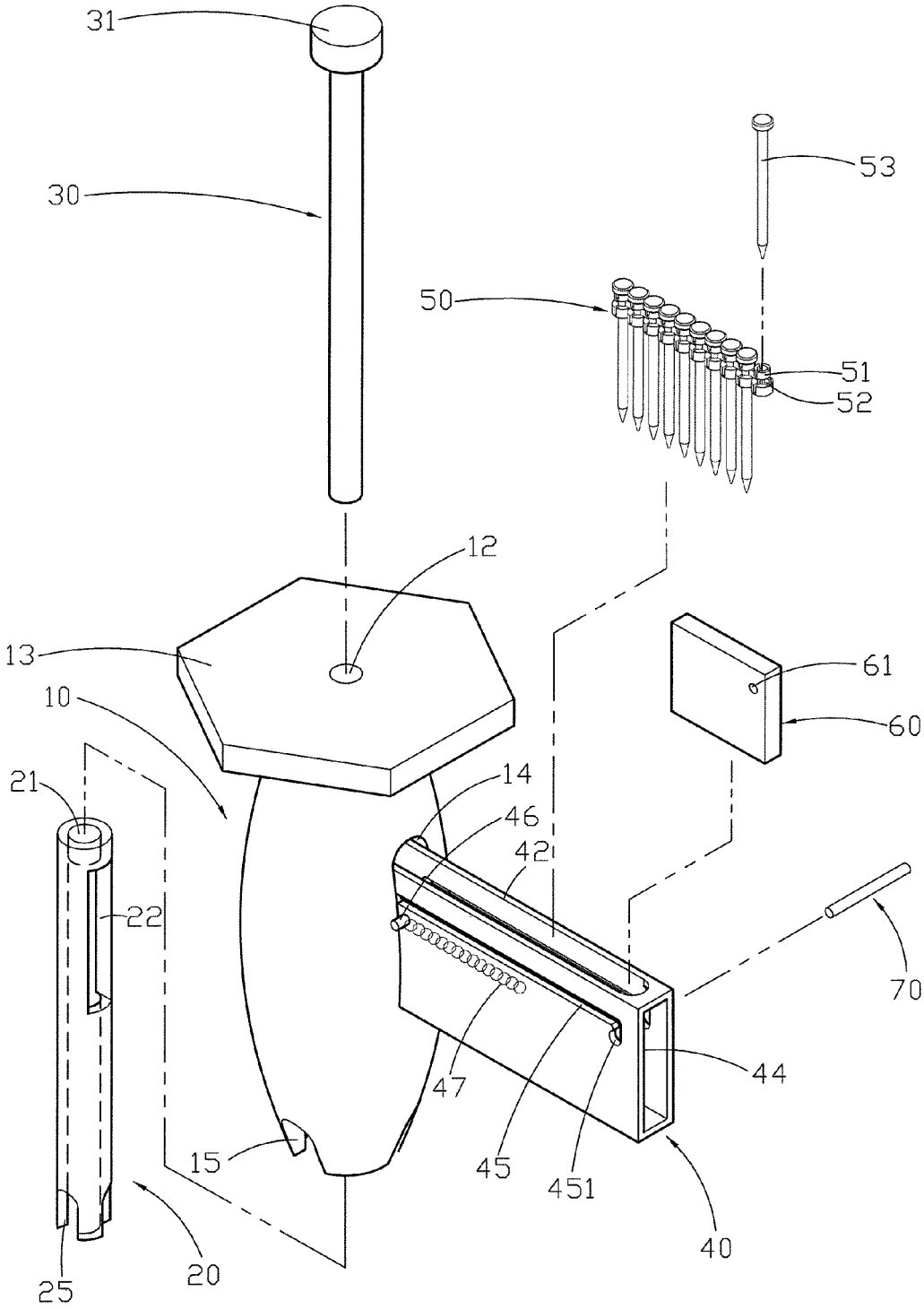
FIG. 2 is an exploded perspective view of the nail pusher as shown in FIG. 1.
Figure 3:
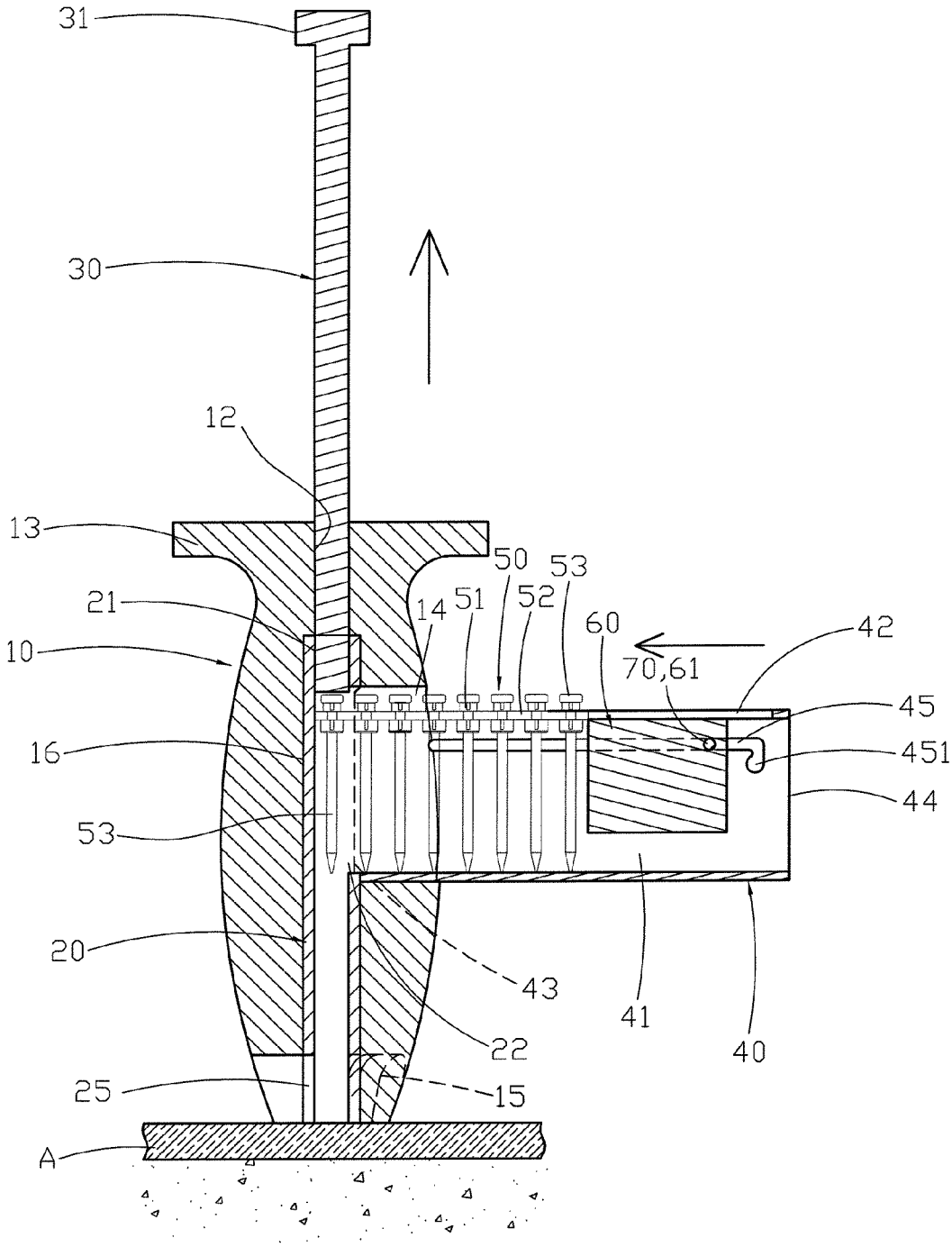
FIG. 3 is a front cross-sectional operational view of the nail pusher as shown in FIG. 1.

Referring to the drawings and initially to FIGS. 1-3, a nail pusher in accordance with the preferred embodiment of the present invention comprises a handle 10, a guide tube 20 mounted in the handle 10 and having a peripheral wall provided with a nail guide slot 22, a nail magazine 40 mounted on the handle 10 and connected to the nail guide slot 22 of the guide tube 20, a plurality of nails 53 mounted in the nail magazine 40, a push member 60 movably mounted in the nail magazine 40 and abutting the nails 53 to push each of the nails 53 through the nail guide slot 22 of the guide tube 20 into the guide tube 20, and a thrusting rod 30 movably mounted on the handle 10 and movable in the guide tube 20 to thrust one of the nails 53 in the guide tube 20 and to eject one of the nails 53 outwardly from the guide tube 20.

The handle 10 has a substantially oblong shape. The handle 10 has an upper end provided with a guiding hole 12 to guide movement of the thrusting rod 30 and a lower end provided with a fixing hole 16 to fix the guide tube 20. The guiding hole 12 of the handle 10 is connected to the guide tube 20, and the fixing hole 16 of the handle 10 is connected to the guiding hole 12 of the handle 10. The fixing hole 16 of the handle 10 has a diameter greater than that of the guiding hole 12. The handle 10 has a top provided with an enlarged protective block 13 and a bottom provided with a plurality of openings 15. Each of the openings 15 of the handle 10 is connected to the fixing hole 16 of the handle 10. The protective block 13 of the handle 10 has a substantially hexagonal shape. The handle 10 has a peripheral wall provided with a receiving slot 14 to receive the nail magazine 40. The receiving slot 14 of the handle 10 is connected to the fixing hole 16 of the handle 10 and the nail guide slot 22 of the guide tube 20.

The guide tube 20 has an inner portion provided with a bore 21 to allow movement of the thrusting rod 30. The bore 21 of the guide tube 20 is connected to the nail guide slot 22 of the guide tube 20 and the guiding hole 12 of the handle 10. The guide tube 20 has an upper end provided with the nail guide slot 22 and a lower end provided with a plurality of breaches 25 connected to the openings 15 of the handle 10. The breaches 25 of the guide tube 20 are connected to the bore 21 of the guide tube 20.

The thrusting rod 30 is movable in the guiding hole 12 of the handle 10 and the bore 21 of the guide tube 20. The thrusting rod 30 has an upper end provided with an enlarged striking head 31 that is movable to abut the protective block 13 of the handle 10.

The nail magazine 40 is a rectangular hollow case. The nail magazine 40 has an inner portion provided with a receiving space 41 to receive the nails 53 and the push member 60. The nail magazine 40 has first end provided with a nail outlet 43 connected to the nail guide slot 22 of the guide tube 20 and the receiving space 41 of the nail magazine 40 to introduce the nails 53 through the nail guide slot 22 of the guide tube 20 into the bore 21 of the guide tube 20. The nail outlet 43 of the nail magazine 40 is inserted into the receiving slot 14 of the handle 10 and is stopped by a peripheral wall of the nail guide slot 22 of the guide tube 20. The nail magazine 40 has a second end provided with an entrance 44 connected to the receiving space 41 of the nail magazine 40 to allow entrance of the push member 60. The nail magazine 40 has a top provided with an elongate slideway 42 connected to the receiving space 41 of the nail magazine 40 to guide movement of the nails 53. The nail magazine 40 is provided with two opposite elongate guiding channels 45 formed in two opposite sidewalls of the nail magazine 40. Each of the guiding channels 45 of the nail magazine 40 is connected to the receiving space 41 of the nail magazine 40 and has a first end extending to the receiving slot 14 of the handle 10 and a second end provided with a positioning groove 451 which is perpendicular to the respective guiding groove 45 of the nail magazine 40 and is located beside the entrance 44 of the nail magazine 40. The nail magazine 40 has a surface provided with at least one protruding limit post 46 abutting a peripheral wall of the receiving slot 14 of the handle 10.

The nail pusher further comprises a control rod 70 extending through the push member 60 and movable in the guiding channels 45 of the nail magazine 40 to move the push member 60 in the receiving space 41 of the nail magazine 40, and at least one elastic member 47 biased between the limit post 46 of the nail magazine 40 and the control rod 70 to push the control rod 70, the push member 60 and the nails 53 toward the nail outlet 43 of the nail magazine 40 and the nail guide slot 22 of the guide tube 20 so as to introduce the nails 53 through the nail outlet 43 of the nail magazine 40 and the nail guide slot 22 of the guide tube 20 into the bore 21 of the guide tube 20.

The control rod 70 has two opposite ends protruding outwardly from the guiding channels 45 of the nail magazine 40. The control rod 70 is detachably locked in the positioning groove 451 of each of the guiding channels 45 of the nail magazine 40 to lock the push member 60 in the receiving space 41 of the nail magazine 40 temporarily. The push member 60 is a substantially rectangular block. The push member 60 is provided with a through hole 61 to allow passage of the control rod 70.

The nails 53 are serially connected with each other by a retaining module 50 which is slidable in the slideway 42 of the nail magazine 40. The retaining module 50 is pushed by the push member 60 to move toward the nail outlet 43 of the nail magazine 40. The retaining module 50 includes a plurality of limit rings 51 each surrounding a respective one of the nails 53 and a plurality of connecting pieces 52 detachably connected between the limit rings 51.

As shown in FIG. 3, the thrusting rod 30 is movable upward to detach from the nail guide slot 22 of the guide tube 20, so that the push member 60 is pushed by the elastic force of the elastic member 47 to push the nails 53 toward the nail outlet 43 of the nail magazine 40 and the nail guide slot 22 of the guide tube 20 so as to introduce the nails 53 through the nail outlet 43 of the nail magazine 40 and the nail guide slot 22 of the guide tube 20 into the bore 21 of the guide tube 20. At this time, only a single one of the nails 53 is allowed to enter the bore 21 of the guide tube 20.

Figure 4:
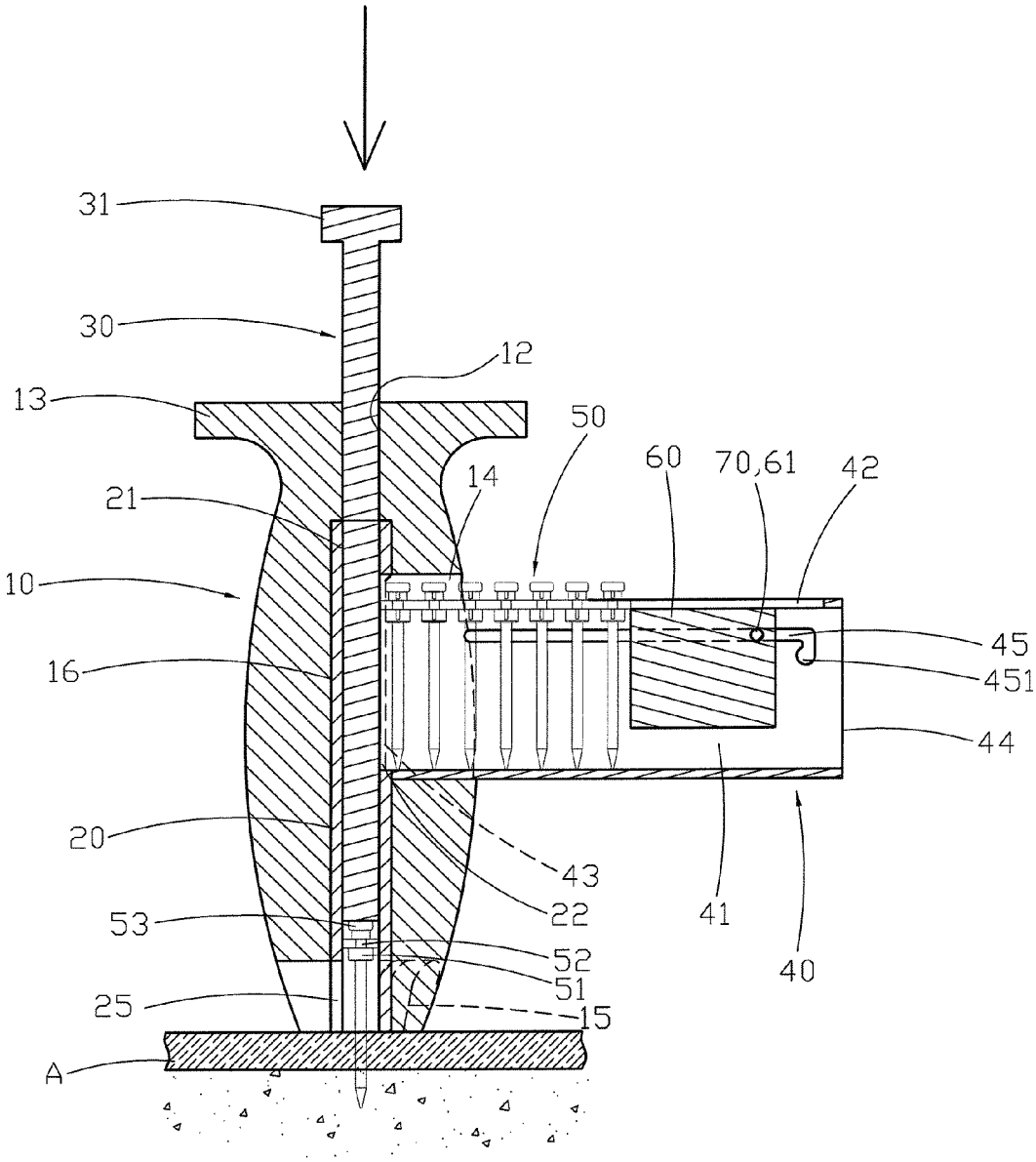
FIG. 4 is a schematic operational view of the nail pusher as shown in FIG. 3.

As shown in FIG. 4, when the striking head 31 of the thrusting rod 30 is hit by a hammer, the thrusting rod 30 is movable downward to break and separate the respective limit ring 51 and the respective connecting piece 52 of the retaining module 50 from one of the nails 53 and to move one of the nails 53 downward so that one of the nails 53 is ejected outwardly from the bore 21 of the guide tube 20 and is forced into an object "A", such as a wooden board.

Figure 5:
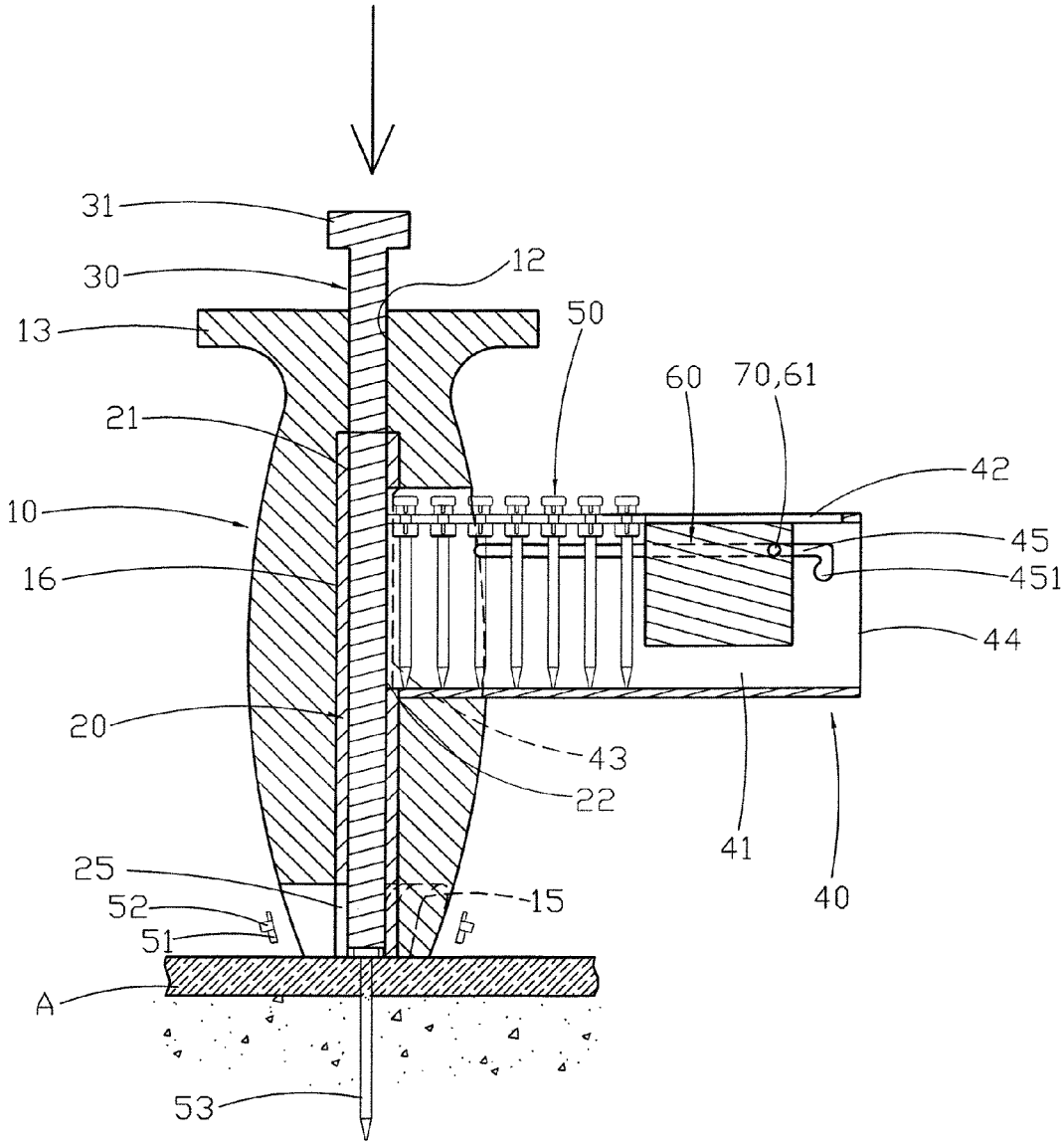
FIG. 5 is a schematic operational view of the nail pusher as shown in FIG. 4.

As shown in FIG. 5, when the striking head 31 of the thrusting rod 30 is hit successively, one of the nails 53 is forced into the object "A" completely, and the respective limit ring 51 and the respective connecting piece 52 of the retaining module 50 are injected outwardly from the openings 15 of the handle 10 and the breaches 25 of the guide tube 20.

In such a manner, the above-mentioned procedures as shown in FIGS. 3-5 are repeated successively. Thus, the push member 60 is pushed by the elastic member 47 to push the nails 53 into the bore 21 of the guide tube 20 successively, and the nails 53 are ejected outwardly from the bore 21 of the guide tube 20 successively, so that the nail pusher can push and eject the nails 53 successively.

Figure 6:
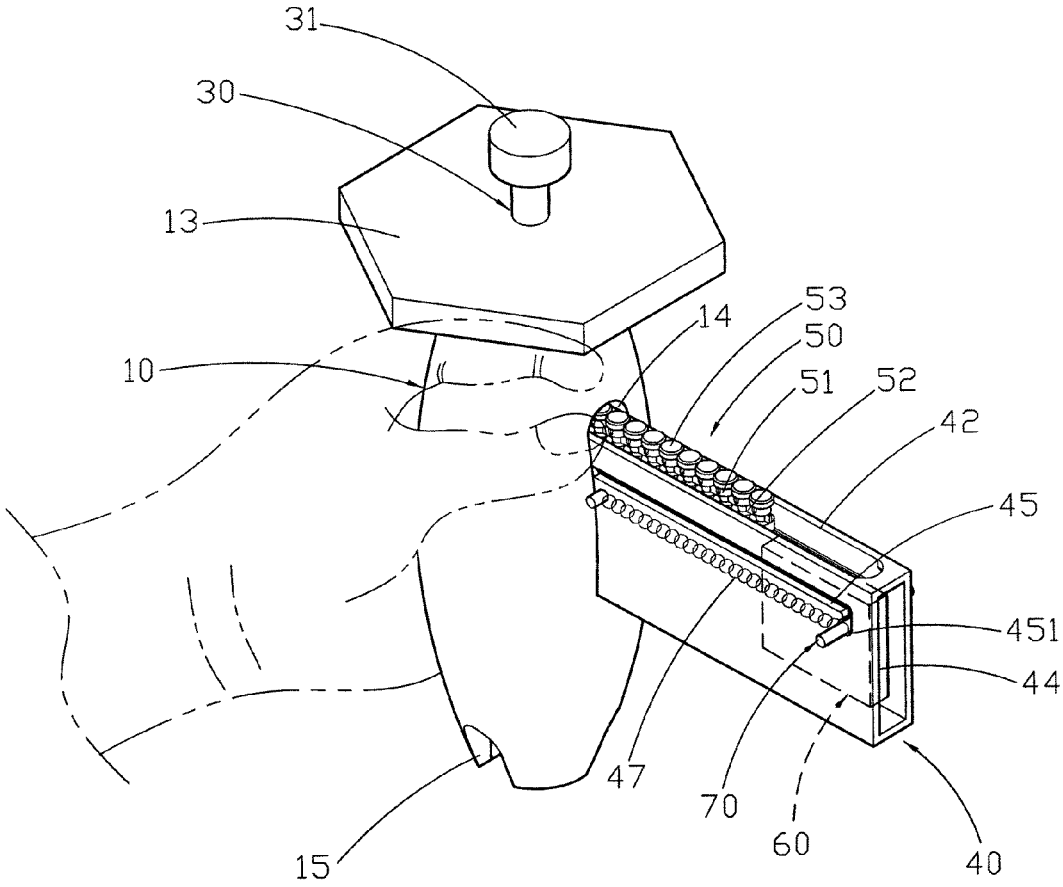
FIG. 6 is a schematic operational view of the nail pusher as shown in FIG. 1.

As shown in FIG. 6, the striking head 31 of the thrusting rod 30 has a circular shape and is hit by a hammer.

Figure 7:
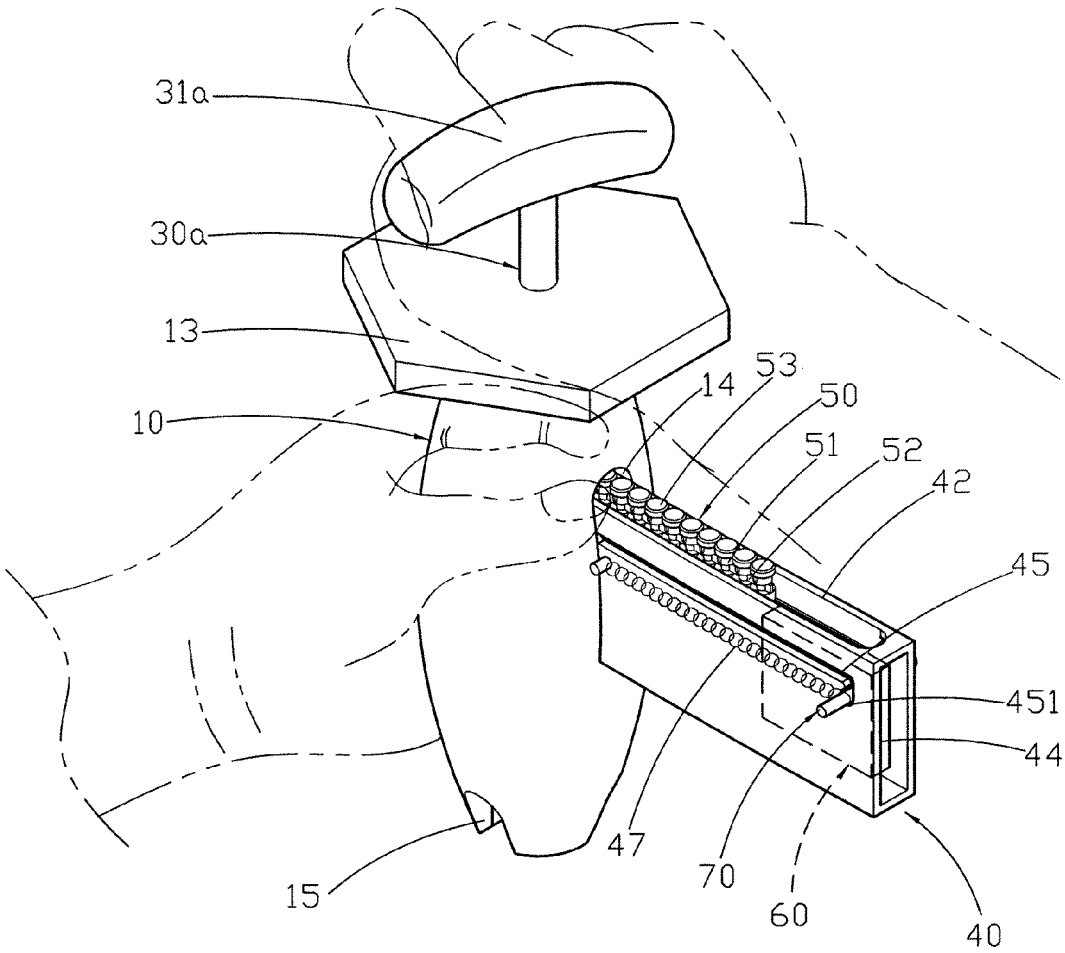
FIG. 7 is a schematic perspective operational view of a nail pusher in accordance with another preferred embodiment of the present invention.
Figure 8:
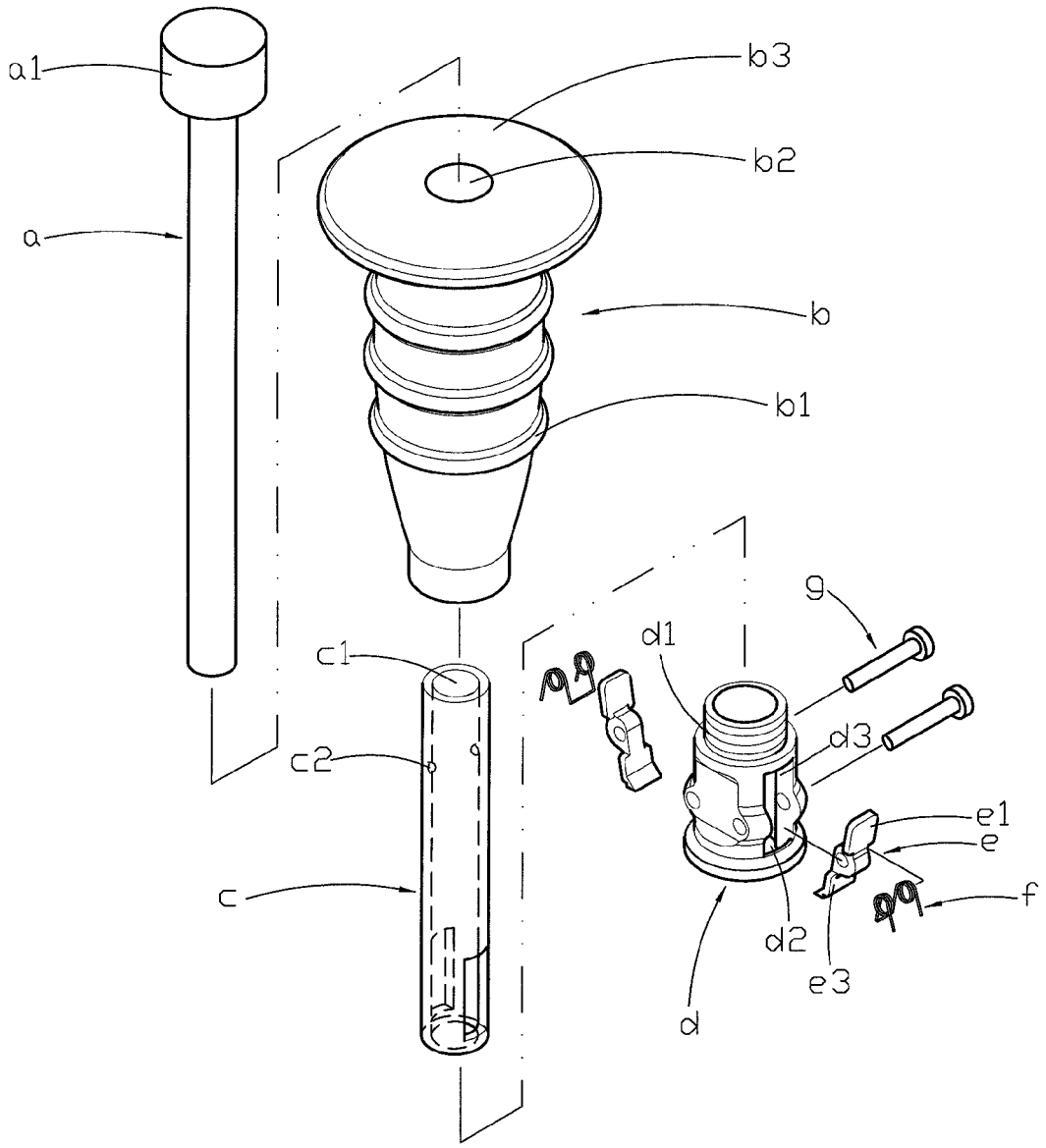
FIG. 8 PRIOR ART
FIG. 8 is an exploded perspective view of a conventional nail pusher in accordance with the prior art.
Figure 9:
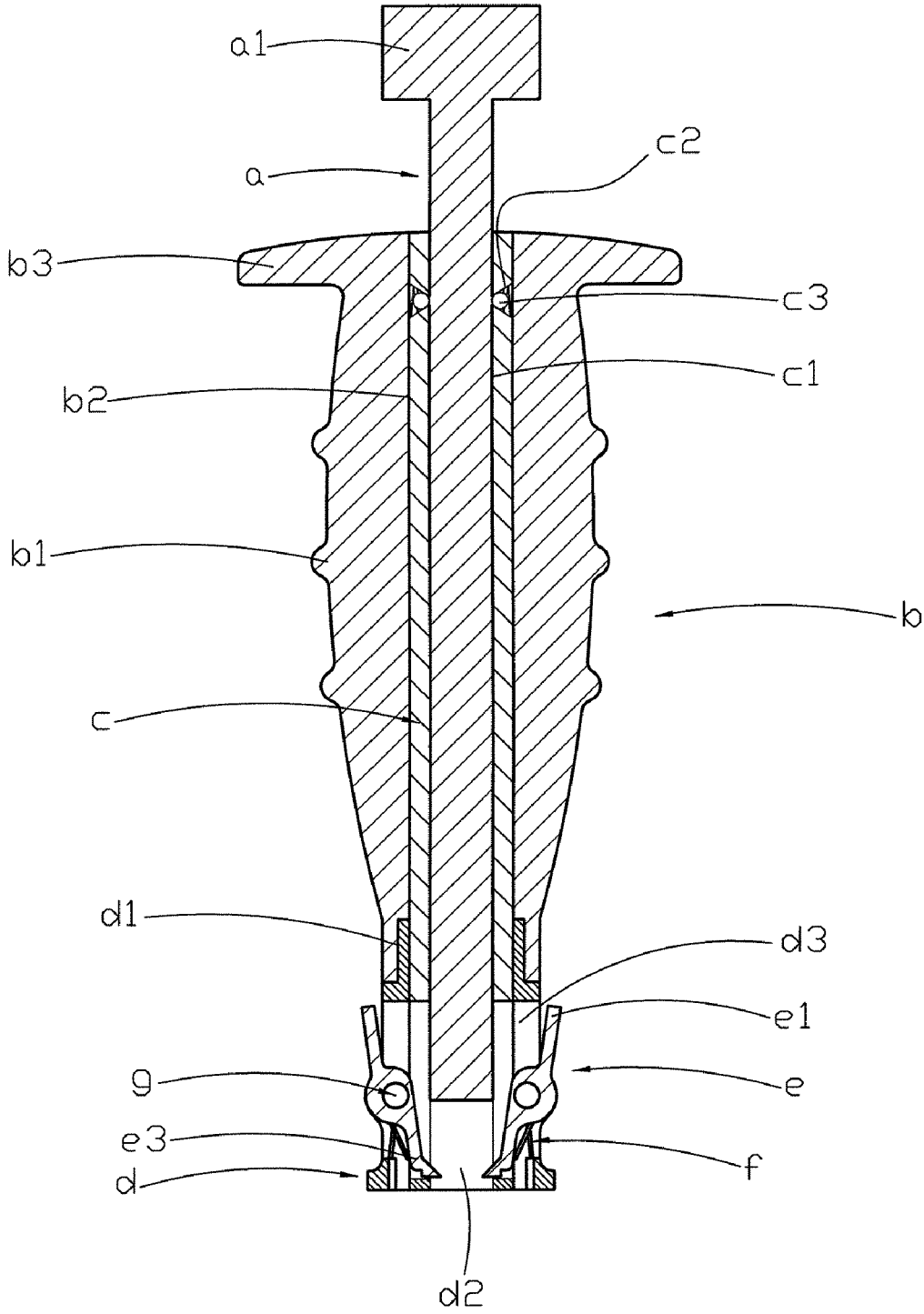
FIG. 9 PRIOR ART
FIG. 9 is a front cross-sectional assembly view of the conventional nail pusher as shown in FIG. 8.

As shown in FIG. 7, the striking head 31*a* of the thrusting rod 30*a* has an elongate shape and is hit by the user's palm.

Accordingly, the push member 60 is pushed by the elastic member 47 to introduce each of the nails 53 into the bore 21 of the guide tube 20 successively, and the nails 53 are ejected outwardly from the bore 21 of the guide tube 20 successively, so that the nail pusher can push and eject the nails 53 successively. In addition, the push member 60 is pushed by the elastic member 47 to introduce each of the nails 53 into the bore 21 of the guide tube 20 successively, so that the nails 53 are fed into the bore 21 of the guide tube 20 automatically, thereby facilitating the user feeding the nails 53.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A nail pusher, comprising:

a handle, a guide tube mounted in the handle and having a peripheral wall provided with a nail guide slot, a nail magazine mounted on the handle and connected to the nail guide slot of the guide tube, a plurality of nails mounted in the nail magazine, a push member movably mounted in the nail magazine and abutting the nails to push each of the nails through the nail guide slot of the guide tube into the guide tube, and a thrusting rod movably mounted on the handle and movable in the guide tube to thrust one of the nails in the guide tube and to eject one of the nails outwardly from the guide tube; wherein:

the handle has an upper end provided with a guiding hole to guide movement of the thrusting rod;

the guide tube has an inner portion provided with a bore to allow movement of the thrusting rod;

the bore of the guide tube is connected to the nail guide slot of the guide tube and the guiding hole of the handle;

the nail magazine has an inner portion provided with a receiving space to receive the nails and the push member;

the nail magazine has first end provided with a nail outlet connected to the nail guide slot of the guide tube and the receiving space of the nail magazine to introduce the nails through the nail guide slot of the guide tube into the bore of the guide tube;

the handle has a peripheral wall provided with a receiving slot to receive the nail magazine;

the nail magazine is provided with two opposite elongate guiding channels formed in two opposite sidewalls of the nail magazine;

the nail magazine has a surface provided with at least one protruding limit post abutting a peripheral wall of the receiving slot of the handle;

the nail pusher further comprises:

a control rod extending through the push member and movable in the guiding channels of the nail magazine to move the push member in the receiving space of the nail magazine;

at least one elastic member biased between the limit post of the nail magazine and the control rod to push the control rod, the push member and the nails toward the nail outlet of the nail magazine and the nail guide slot of the guide tube so as to introduce the nails through the nail outlet of the nail magazine and the nail guide slot of the guide tube into the bore of the guide tube.

2. The nail pusher of 1, wherein each of the guiding channels of the nail magazine has a first end extending to the receiving slot of the handle and a second end provided with a positioning groove which is perpendicular to the respective guiding groove of the nail magazine;

the control rod is detachably locked in the positioning groove of each of the guiding channels of the nail magazine to lock the push member in the receiving space of the nail magazine temporarily.

3. The nail pusher of claim 1, wherein the nail magazine has a second end provided with an entrance connected to the receiving space of the nail magazine to allow entrance of the push member.

4. The nail pusher of claim 1, wherein the control rod has two opposite ends protruding outwardly from the guiding channels of the nail magazine.

5. The nail pusher of claim 1, wherein the handle has a lower end provided with a fixing hole to fix the guide tube;

the fixing hole of the handle is connected to the guiding hole of the handle;

the fixing hole of the handle has a diameter greater than that of the guiding hole.

6. The nail pusher of claim 5, wherein the receiving slot of the handle is connected to the fixing hole of the handle and the nail guide slot of the guide tube.

7. The nail pusher of claim 1, wherein the handle has a bottom provided with a plurality of openings;

the guide tube has an upper end provided with the nail guide slot and a lower end provided with a plurality of breaches connected to the openings of the handle;

the breaches of the guide tube are connected to the bore of the guide tube.

8. The nail pusher of claim 1, wherein the handle has a top provided with an enlarged protective block;

the thrusting rod has an upper end provided with an enlarged striking head that is movable to abut the protective block of the handle.

9. The nail pusher of claim 8, wherein the striking head of the thrusting rod has an elongate shape.

10. The nail pusher of claim 1, wherein the nail outlet of the nail magazine is inserted into the receiving slot of the handle and is stopped by a peripheral wall of the nail guide slot of the guide tube.

11. The nail pusher of claim 1, wherein the push member is a substantially rectangular block;

the push member is provided with a through hole to allow passage of the control rod.

12. The nail pusher of claim 1, wherein the nail magazine is a rectangular hollow case;

the handle has a substantially oblong shape.

13. The nail pusher of claim 1, wherein each of the guiding channels of the nail magazine is connected to the receiving space of the nail magazine.

14. The nail pusher of claim 1, wherein the thrusting rod is movable in the guiding hole of the handle and the bore of the guide tube.

15. A nail pusher, comprising:

a handle, a guide tube mounted in the handle and having a peripheral wall provided with a nail guide slot, a nail magazine mounted on the handle and connected to the nail guide slot of the guide tube, a plurality of nails mounted in the nail magazine, a push member movably mounted in the nail magazine and abutting the nails to push each of the nails through the nail guide slot of the guide tube into the guide tube, and a thrusting rod movably mounted on the handle and movable in the guide tube to thrust one of the nails in the guide tube and to eject one of the nails outwardly from the guide tube; wherein:

the handle has an upper end provided with a guiding hole to guide movement of the thrusting rod;

the guide tube has an inner portion provided with a bore to allow movement of the thrusting rod;

the bore of the guide tube is connected to the nail guide slot of the guide tube and the guiding hole of the handle;

the nail magazine has an inner portion provided with a receiving space to receive the nails and the push member;

the nail magazine has first end provided with a nail outlet connected to the nail guide slot of the guide tube and the receiving space of the nail magazine to introduce the nails through the nail guide slot of the guide tube into the bore of the guide tube;

the nail magazine has a top provided with an elongate slideway connected to the receiving space of the nail magazine to guide movement of the nails;

the nails are serially connected with each other by a retaining module which is slidable in the slideway of the nail magazine;

the retaining module includes:

a plurality of limit rings each surrounding a respective one of the nails;

a plurality of connecting pieces detachably connected between the limit rings.

16. The nail pusher of claim 15, wherein the retaining module is pushed by the push member to move toward the nail outlet of the nail magazine.

* * * * *